US010760868B2

(12) United States Patent
Schwendemann et al.

(10) Patent No.: US 10,760,868 B2
(45) Date of Patent: Sep. 1, 2020

(54) WEIGHTED REPLICA FIREARM

(71) Applicant: Fitness Combat Systems, LLC, Kansas City, MO (US)

(72) Inventors: Cory R. Schwendemann, Olathe, KS (US); Cetin S. Duvenci, Kansas City, MO (US)

(73) Assignee: Fitness Combat Systems, LLC, Kansas City, MO (US)

( * ) Notice: Subject to any disclaimer, the term of this patent is extended or adjusted under 35 U.S.C. 154(b) by 148 days.

(21) Appl. No.: 15/817,821

(22) Filed: Nov. 20, 2017

(65) Prior Publication Data

US 2018/0142982 A1 May 24, 2018

Related U.S. Application Data

(60) Provisional application No. 62/424,091, filed on Nov. 18, 2016.

(51) Int. Cl.

| | |
|---|---|
| ***F41A 33/00*** | (2006.01) |
| ***F41C 27/00*** | (2006.01) |
| ***A63B 21/055*** | (2006.01) |
| ***A63B 21/06*** | (2006.01) |
| *A63B 23/00* | (2006.01) |

(52) U.S. Cl.

CPC ..... *F41A 33/00* (2013.01); *A63B 21/0552* (2013.01); *A63B 21/0601* (2013.01); *F41C 27/00* (2013.01); *A63B 2023/006* (2013.01)

(58) Field of Classification Search

USPC ..... 434/11, 16, 18; 42/97

See application file for complete search history.

(56) References Cited

U.S. PATENT DOCUMENTS

| | | | | |
|---|---|---|---|---|
| 1,437,797 | A | 12/1922 | Fisher | |
| 2,921,396 | A * | 1/1960 | Larson | F41C 27/22 42/97 |
| 3,604,136 | A | 9/1971 | Edwards | |
| 4,811,955 | A * | 3/1989 | De Bernardini | F41A 19/16 124/32 |
| 6,694,658 | B1 | 2/2004 | Marsac | |
| 7,581,954 | B2 * | 9/2009 | Schavone | F41B 11/51 434/18 |
| 8,448,371 | B1 * | 5/2013 | Wilhelm | F41C 27/22 42/97 |

(Continued)

FOREIGN PATENT DOCUMENTS

| | | |
|---|---|---|
| WO | 2005043066 | 5/2005 |

OTHER PUBLICATIONS

International Search Report and Written Opinion from PCT/US2017/062562 entitled: Weighted Replica Firearm (dated Feb. 20, 2018).

*Primary Examiner* — Kurt Fernstrom
(74) *Attorney, Agent, or Firm* — Hovey Williams LLP

(57) ABSTRACT

A weighted replica firearm is operable to be handled by a user for simulated firearm training. The firearm includes a firearm receiver, a barrel weight support, and barrel weights. The barrel weights are selectively mounted to the barrel weight support. Each barrel weight includes a corresponding weight connection interface removably interconnecting with a support connection interface of the barrel weight support when the barrel weight is mounted to the barrel weight support.

14 Claims, 10 Drawing Sheets

(56) References Cited

U.S. PATENT DOCUMENTS

| | | | | |
|---|---|---|---|---|
| 8,646,201 | B2 * | 2/2014 | Hughes | F41A 33/02 42/114 |
| 8,863,426 | B1 * | 10/2014 | Zinsner | F41C 23/16 42/71.01 |
| 9,995,557 | B2 * | 6/2018 | Geissele | F41C 23/02 |
| 2004/0137411 | A1 * | 7/2004 | Kemp | F41A 33/02 434/11 |
| 2016/0209162 | A1 | 7/2016 | Geissele | |

* cited by examiner

WEIGHTED REPLICA FIREARM

RELATED APPLICATION

This application claims the benefit of U.S. Provisional Application Ser. No. 62/424,091, filed Nov. 18, 2016, entitled WEIGHTED REPLICA FIREARM, which is hereby incorporated in its entirety by reference herein.

BACKGROUND

1. Field

The present invention relates generally to firearms and firearm training equipment. More specifically, embodiments of the present invention concern a weighted replica firearm configured for simulated firearm training.

2. Discussion of Prior Art

Conventional firearms, in various forms such as a handgun, rifle, or shotgun, include a number of well-known components, such as a receiver, firing mechanism, grip, and barrel. These components are constructed to facilitate the efficient and accurate use of the firearm. These components are also configured to minimize the weight and bulk associated with the firearm. Firearm users, such as law enforcement and military personnel, frequently train with a firearm to become familiar with the firearm, to enhance personal fitness, and to become accustomed to using the firearm in particular situations.

Prior art firearms have a number of deficiencies, particularly for fitness training and simulated training. For instance, known firearms are not operable to be customized for a range of cardiovascular and resistance training purposes. For example, known firearms lack the ability to customize weight distribution along the firearm, e.g., to provide an unusual or otherwise enhanced fitness challenge to the user.

SUMMARY

The following brief summary is provided to indicate the nature of the subject matter disclosed herein. While certain aspects of the present invention are described below, the summary is not intended to limit the scope of the present invention.

Embodiments of the present invention provide a weighted replica firearm that does not suffer from the problems and limitations of the prior art devices, including but not limited to those noted above.

A first aspect of the present invention concerns a weighted replica firearm operable to be handled by a user for simulated firearm training. The weighted replica firearm broadly includes a firearm receiver, a barrel weight support, and a plurality of removable barrel weights. The receiver is configured to be grasped by the user. The barrel weight support is associated with the firearm receiver. The barrel weight support includes a support connection interface. The barrel weights are selectively mounted to the barrel weight support. Each of the barrel weights includes a corresponding weight connection interface removably interconnecting with the support connection interface when the barrel weight is mounted to the barrel weight support.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 6:
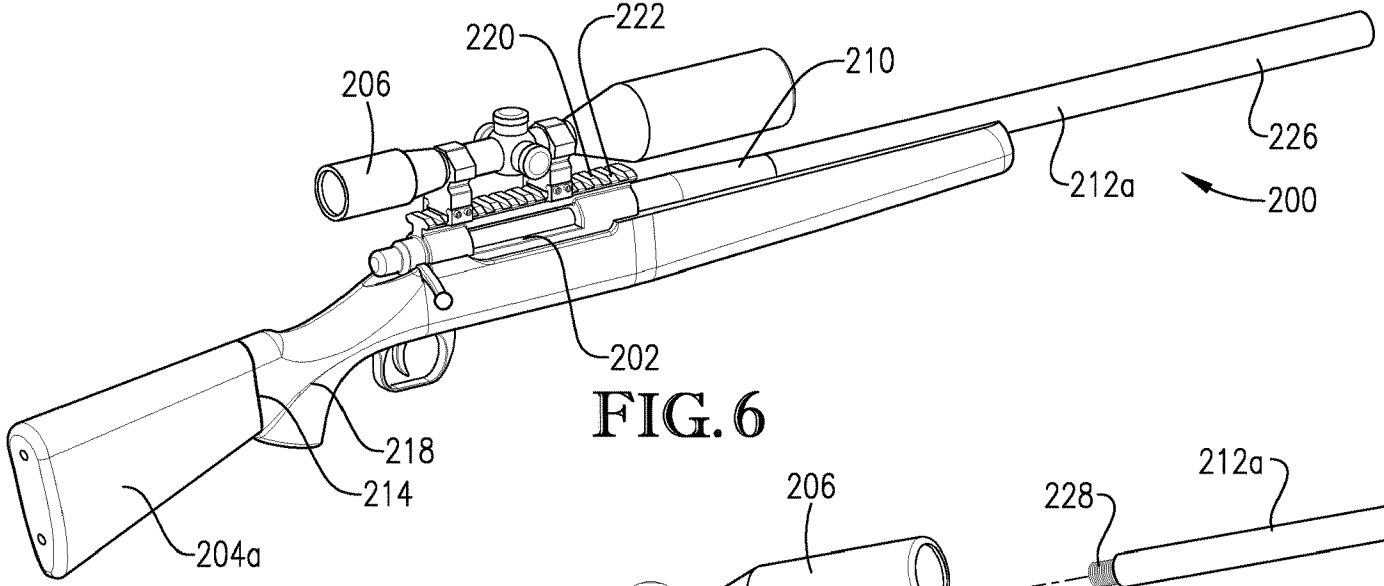
FIG. 6 is a perspective of a weighted replica firearm constructed in accordance with a second preferred embodiment of the present invention, with the firearm including a receiver, stock, scope, barrel weight support, and a removable barrel weight, with the barrel weight support and barrel weight cooperatively forming a replicated barrel.
Figure 7:
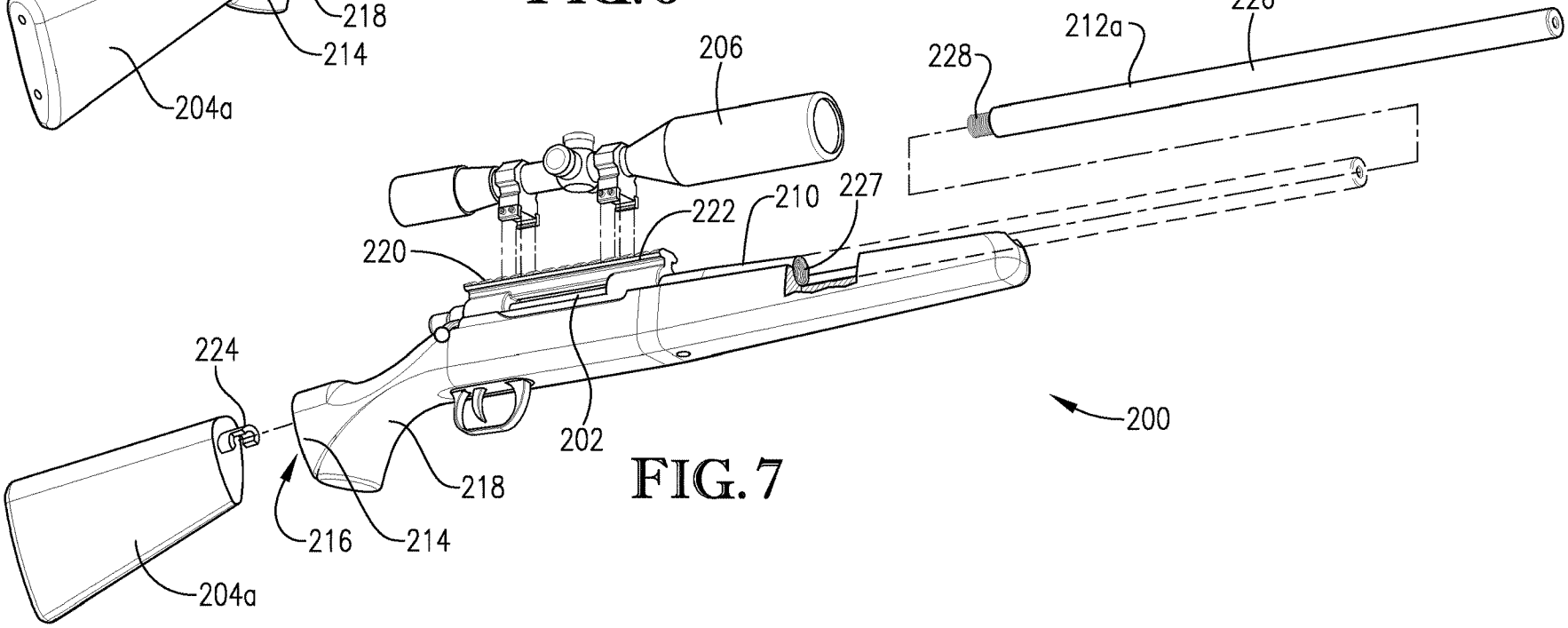
FIG. 7 is an exploded perspective view of the weighted replica firearm shown in FIG. 6, showing the barrel weight detached from the barrel weight support, the stock detached from the receiver, and the scope detached from the receiver.
Figure 8A:
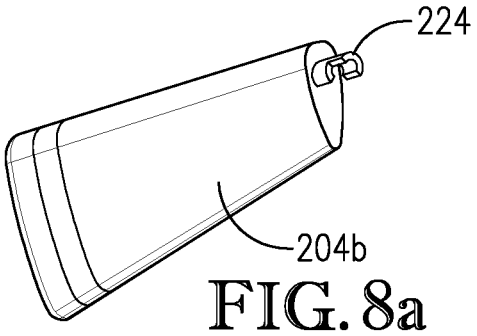
Figure 8B:
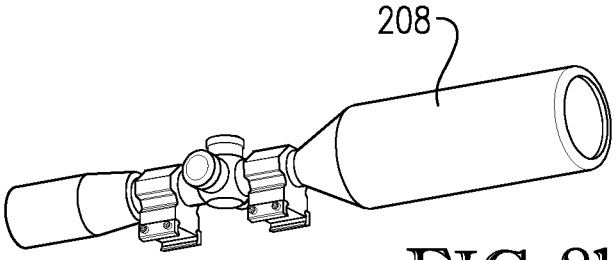
Figure 8C:
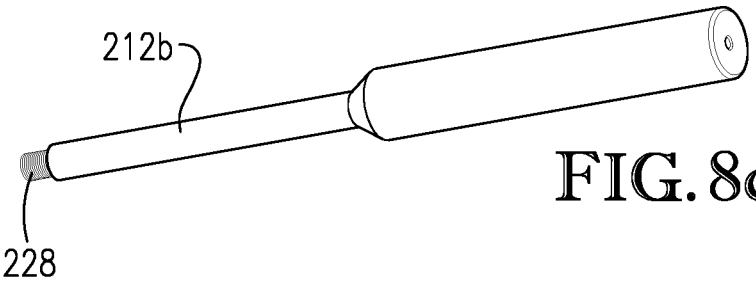
Figure 8D:
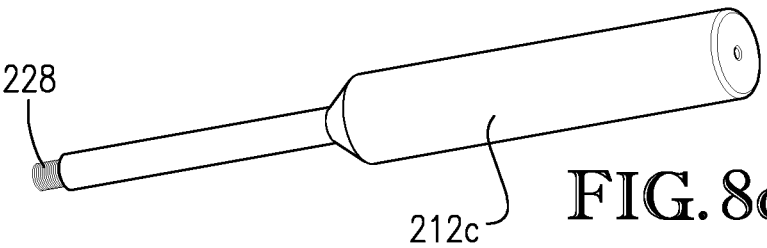
Figures 9, 10, 11A, 11B:
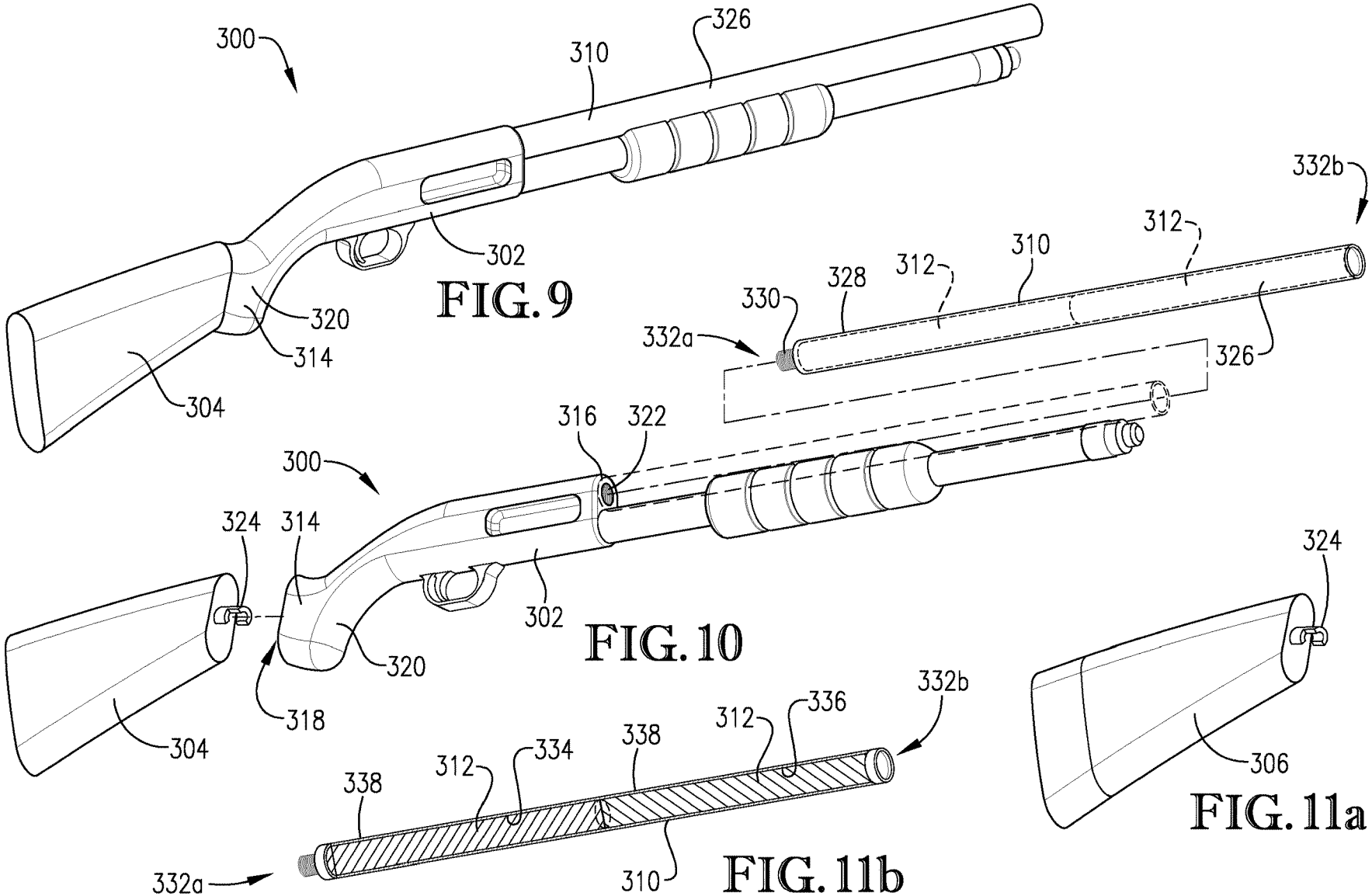
Figures 12, 13, 14A, 14B:
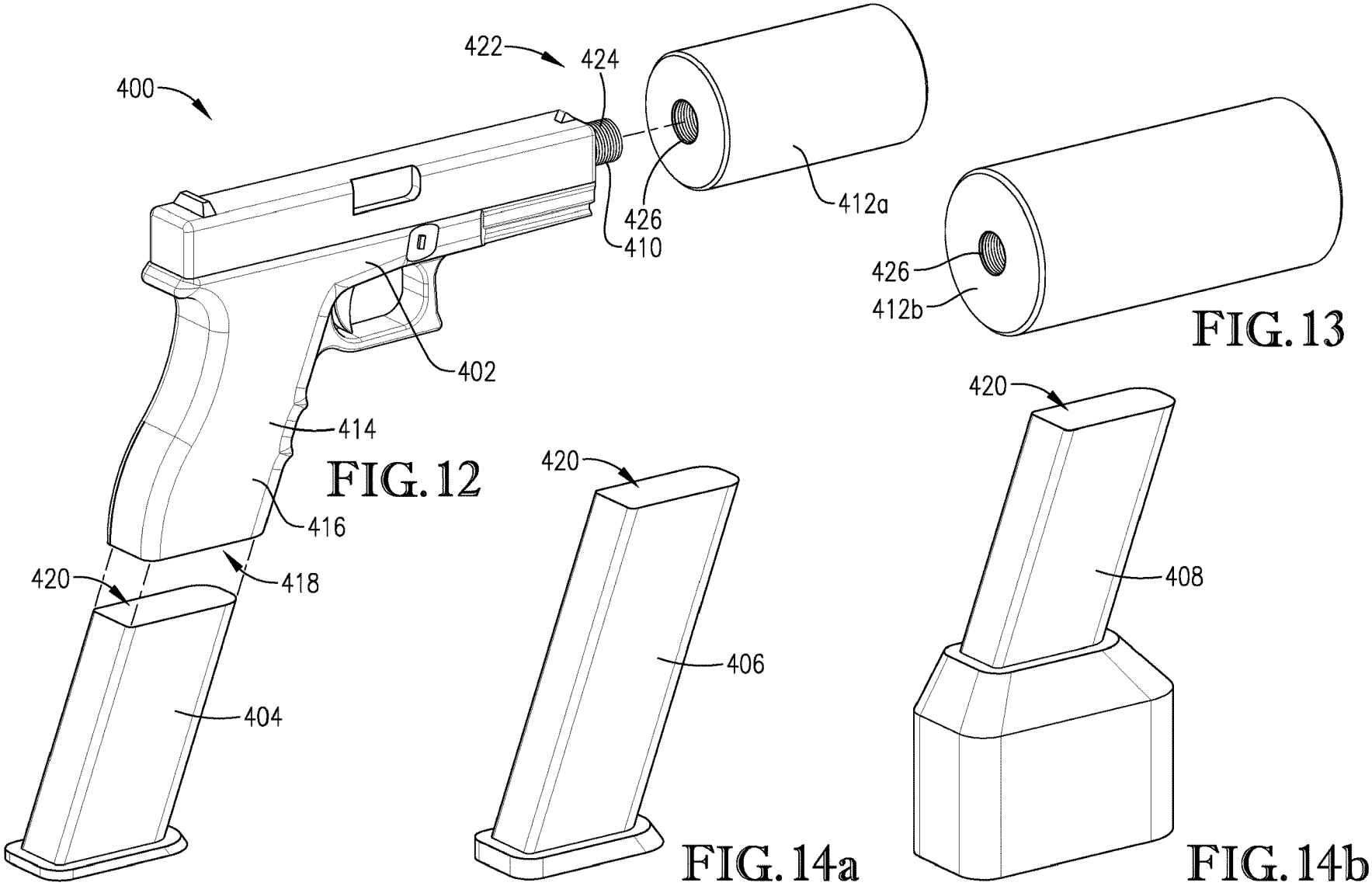
Figures 15, 16A, 16B:
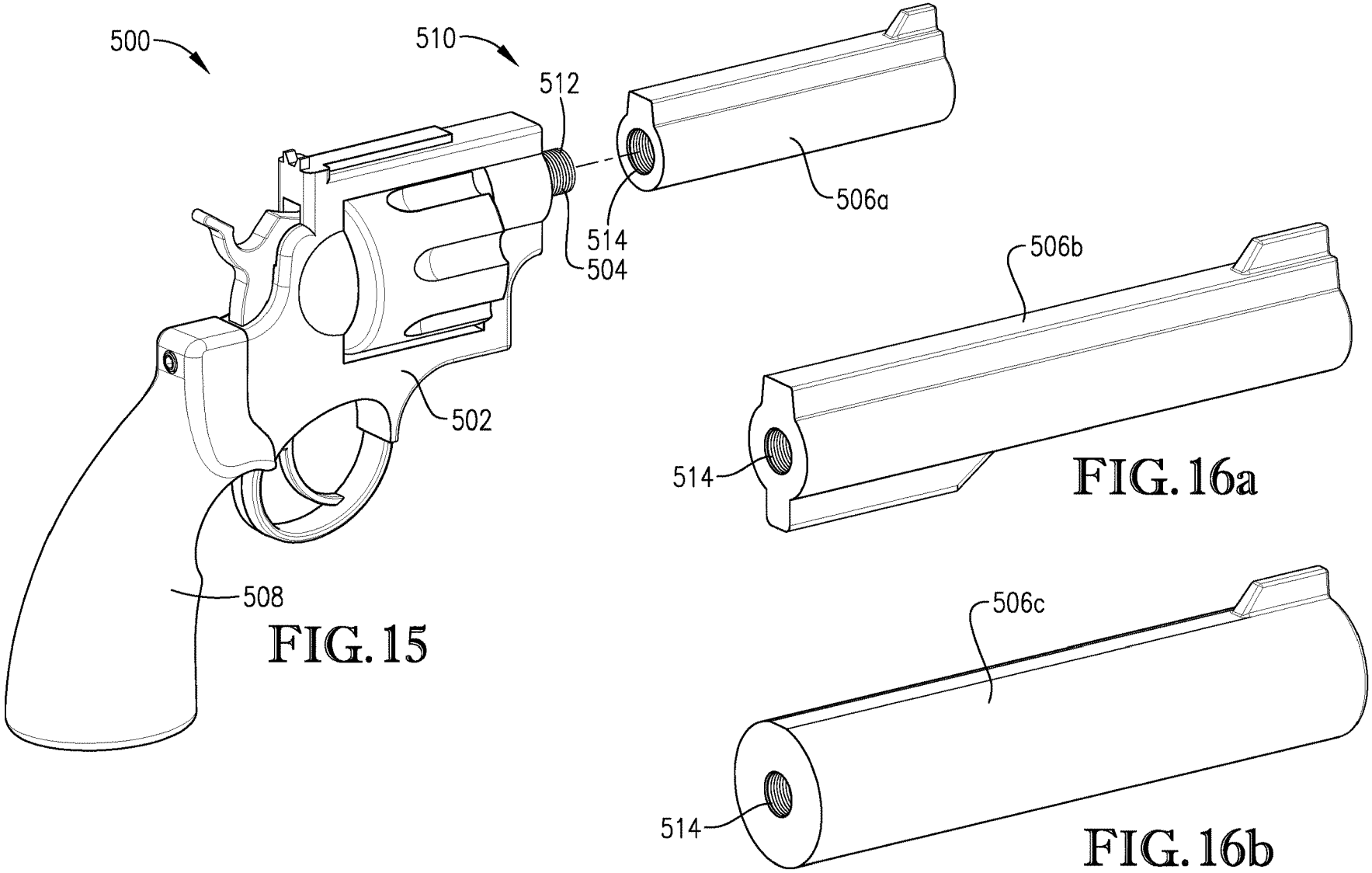

FIG. 8*a* is a perspective of an alternative stock that is interchangeable with the stock depicted in FIGS. 6 and 7;

FIG. 8*b* is a perspective of an alternative scope that is interchangeable with the scope depicted in FIGS. 6 and 7;

FIGS. 8*c* and 8*d* are perspectives of alternative barrel weights that are interchangeable with the barrel weight depicted in FIGS. 6 and 7;

FIG. 9 is a perspective of a weighted replica firearm constructed in accordance with a third preferred embodiment of the present invention, with the firearm including a receiver, stock, barrel weight support, and removable barrel weights, with the barrel weight support and barrel weights cooperatively forming a replicated barrel;

FIG. 10 is an exploded perspective view of the weighted replica firearm shown in FIG. 9, showing both the barrel weight support and the stock detached from the receiver;

FIG. 11*a* is a perspective of an alternative stock that is interchangeable with the stock depicted in FIGS. 6 and 7;

FIG. 11*b* is a fragmentary perspective of the replicated barrel shown in FIGS. 9 and 10, which is partially section to show the barrel weights slidably received by a bore of the barrel weight support;

FIG. 12 is an exploded perspective of a weighted replica firearm constructed in accordance with a fourth preferred embodiment of the present invention, with the firearm including a receiver, magazine, barrel weight support, and removable barrel weight, with the barrel weight support and barrel weight cooperatively forming a replicated barrel;

FIG. 13 is a perspective of an alternative barrel weight that is interchangeable with the barrel weight depicted in FIG. 12;

FIGS. 14*a* and 14*b* are perspectives of alternative magazines that are interchangeable with the magazine depicted in FIG. 12;

FIG. 15 is an exploded perspective of a weighted replica firearm constructed in accordance with a fifth preferred embodiment of the present invention, with the firearm including a receiver, barrel weight support, and removable barrel weight, with the barrel weight support and barrel weight cooperatively forming a replicated barrel; and FIGS. 16*a* and 16*b* are perspectives of alternative barrel weights that are interchangeable with the barrel weight depicted in FIG. 15.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Referring initially to FIGS. 1-5, a weighted replica firearm 20 is preferably configured for simulated firearm training. The depicted replica firearm 20 is dimensioned and configured to simulate an automatic rifle for various exercises, such as stretching, cardiovascular training, and weight training. The replica firearm 20 and exercises can be tailored as part of a training regimen for military personnel, federal agents, state and local law enforcement, and others who frequently use firearms. Although the illustrated firearm 20 is preferred, weighted replica firearms can be variously configured within the ambit of the present invention and some preferred alternatives are depicted in subsequent embodiments.

The replica firearm 20 preferably includes a receiver 22, stock 24, strap 26, magazine 28, barrel weight support 30, and barrel weights 32. As will be discussed, the firearm 20 is preferably configured to simulate the look and feel of a working firearm. At the same time, the depicted firearm 20 includes various weights that are selectively attached to preferably provide a balanced distribution of weight along the firearm 20 (although the user could attach the weights in a relatively imbalanced configuration, e.g., to provide a more demanding exercise routine). While the firearm 20 includes weights that are configured to make the firearm 20 heavier than an equivalent working firearm, such weights can also be configured to provide the firearm 20 with a different overall weight (e.g., where the firearm has the same weight as the equivalent working firearm or is lighter than the equivalent firearm).

The receiver 22 includes a replica firearm frame operable to support other components of the firearm 20. The depicted receiver 22 preferably includes a proximal stock connector 34 and a distal barrel connector 36 (see FIG. 4). In the illustrated embodiment, the proximal stock connector 34 and distal barrel connector 36 define respective proximal and distal receiver ends of the receiver 22 (although one or both of the connectors 34,36 could be spaced from the respective receiver ends).

The proximal stock connector 34 preferably includes a shaft that slidably receives the stock 24. The stock connector 34 also includes a threaded female connection interface 38 (see FIG. 4). As will be discussed, the threaded connection interface 38 is configured to be removably attached to a threaded connection end of the stock 24 to provide a detachable threaded connection.

Figure 4:
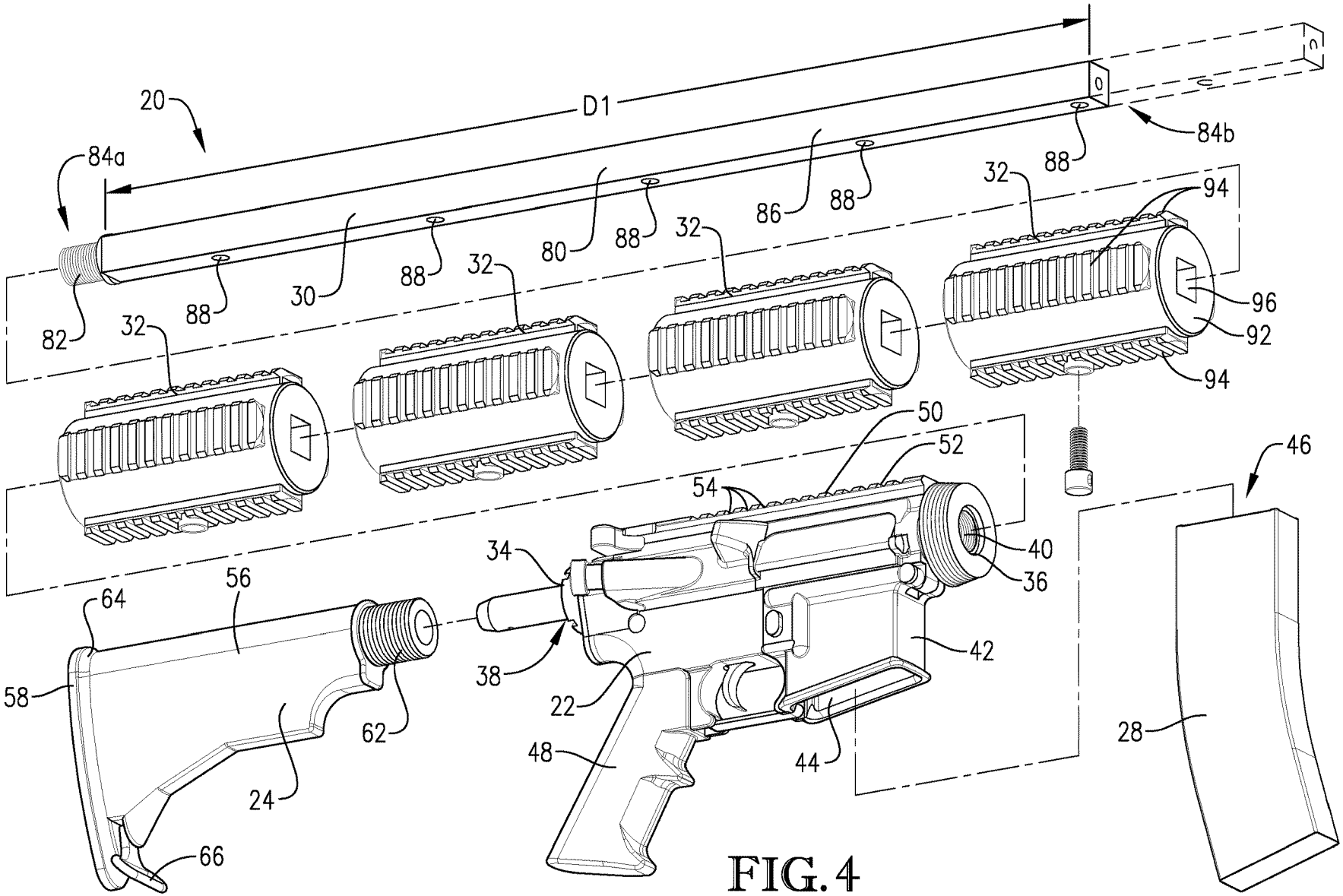
FIG. 4 is an exploded perspective view of the weighted replica firearm shown in FIGS. 1-3.

The distal barrel connector 36 also provides a threaded female connection interface 40 (see FIG. 4). As described below, the threaded connection interface 40 of the distal barrel connector 36 is configured to be removably attached to a threaded connection end of the barrel weight support 30.

The depicted receiver 22 also preferably includes a magazine connector 42 located between the proximal stock connector 34 and the distal barrel connector 36. The magazine connector 42 presents a magazine slot 44 to slidably receive the magazine 28 (see FIG. 4).

The magazine 28 is preferably grasped by a user and removably attached to the receiver 22. The magazine 28 may include at least part of a working ammunition magazine, an unfinished ammunition magazine, or a replica ammunition magazine.

The magazine 28 preferably comprises a unitary body and includes a connection end 46 (see FIG. 4) that is removably attachable to the magazine connector 42.

The connection end 46 of the magazine 28 is configured to be removably inserted within the magazine slot 44 and attached to the magazine connector 42 via a detachable connection mechanism (not shown). For instance, the magazine connector 42 and magazine 28 can include complemental detent elements that cooperatively provide the connection mechanism.

In preferred embodiments, the magazine 28 is preferably configured to add weight to the firearm 20 while simulating the look and feel of a working firearm. Any such weighted structure is configured to add weight to the firearm 20 while preferably providing a balanced distribution of weight particularly along the length of the firearm 20.

The receiver 22 further includes a firearm grip 48 adjacent to the magazine connector 42 and operable to be grasped by a user. The grip 48 is preferably located between the proximal and distal ends of the receiver 22. Thus, the illustrated grip 48 is preferably located distally of the stock 24 and proximally of the magazine 28 and the barrel weights 32. The location of the grip 48 permits the gravitational forces of the stock 24 (including weighted inserts associated with the stock 24) and the barrel weights 32 to at least partly counterbalance one another.

Figure 1:
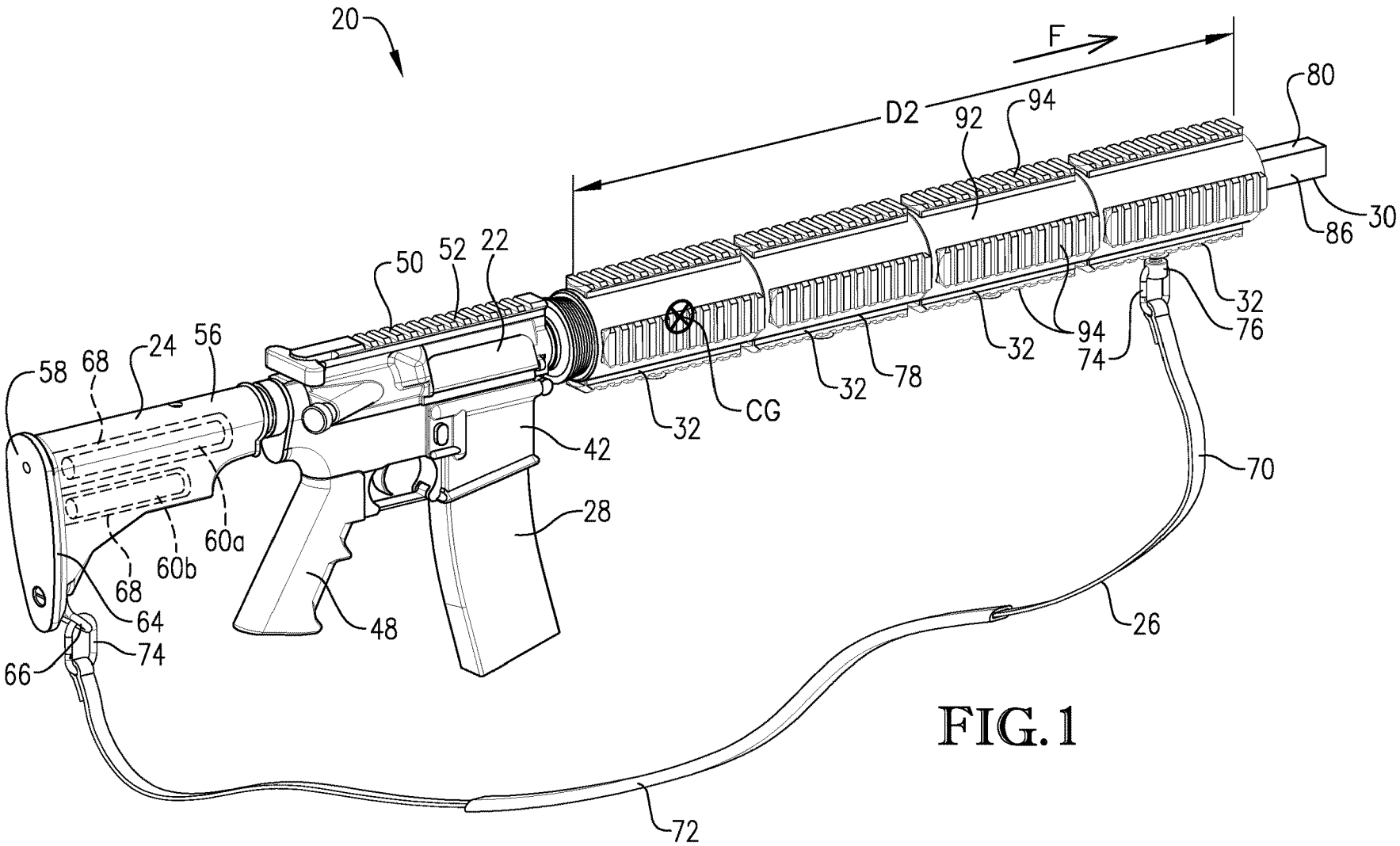
FIG. 1 is a perspective of a weighted replica firearm constructed in accordance with a first preferred embodiment of the present invention, with the firearm including a receiver, stock, strap, magazine, barrel weight support, and barrel weights, with the barrel weight support and barrel weights cooperatively forming a replicated barrel.
Figure 2:
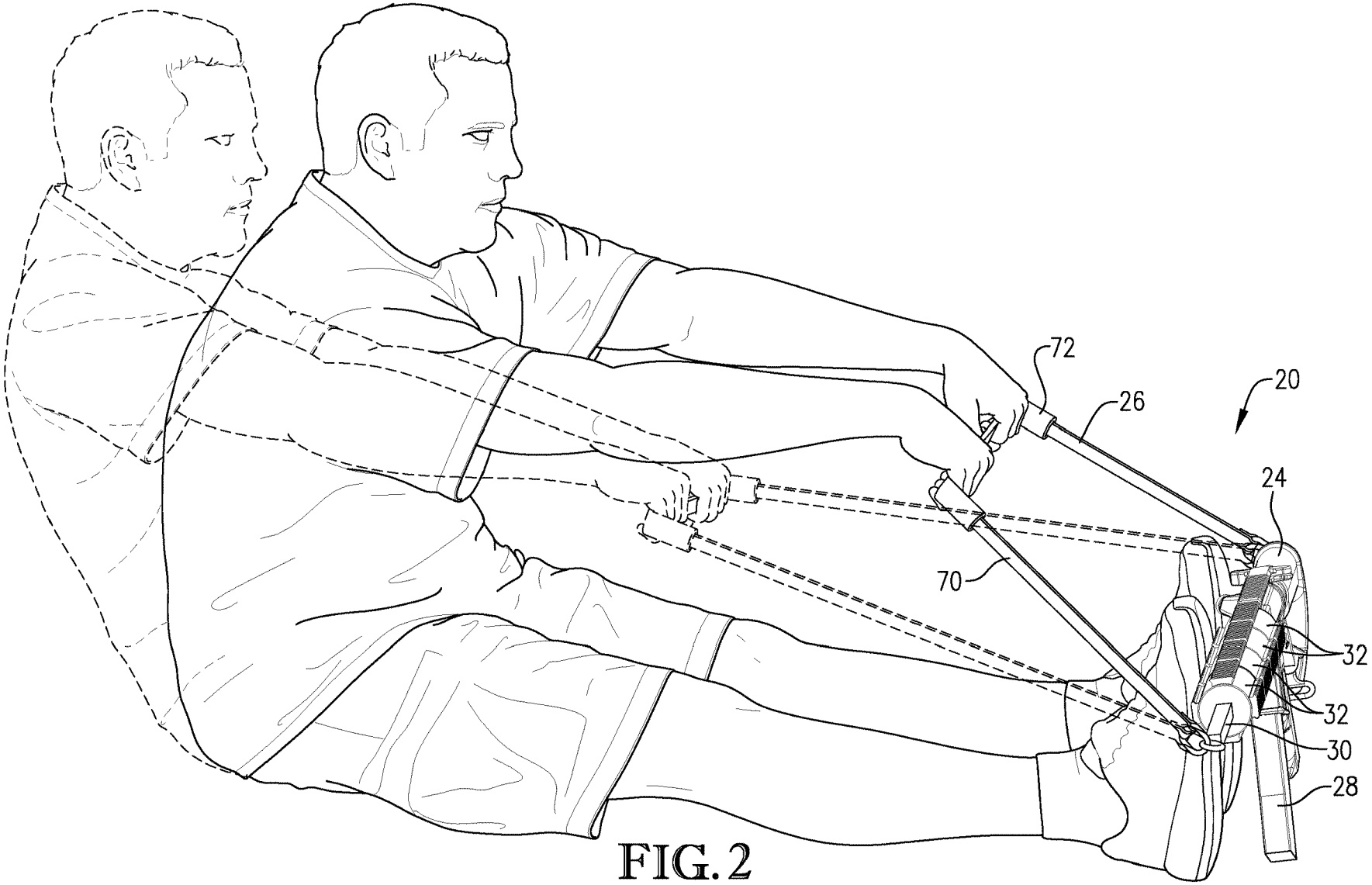
FIG. 2 is a perspective of the weighted replica firearm shown in FIG. 1, showing a user grasping the strap of the firearm while performing a seated row exercise.
Figure 3:
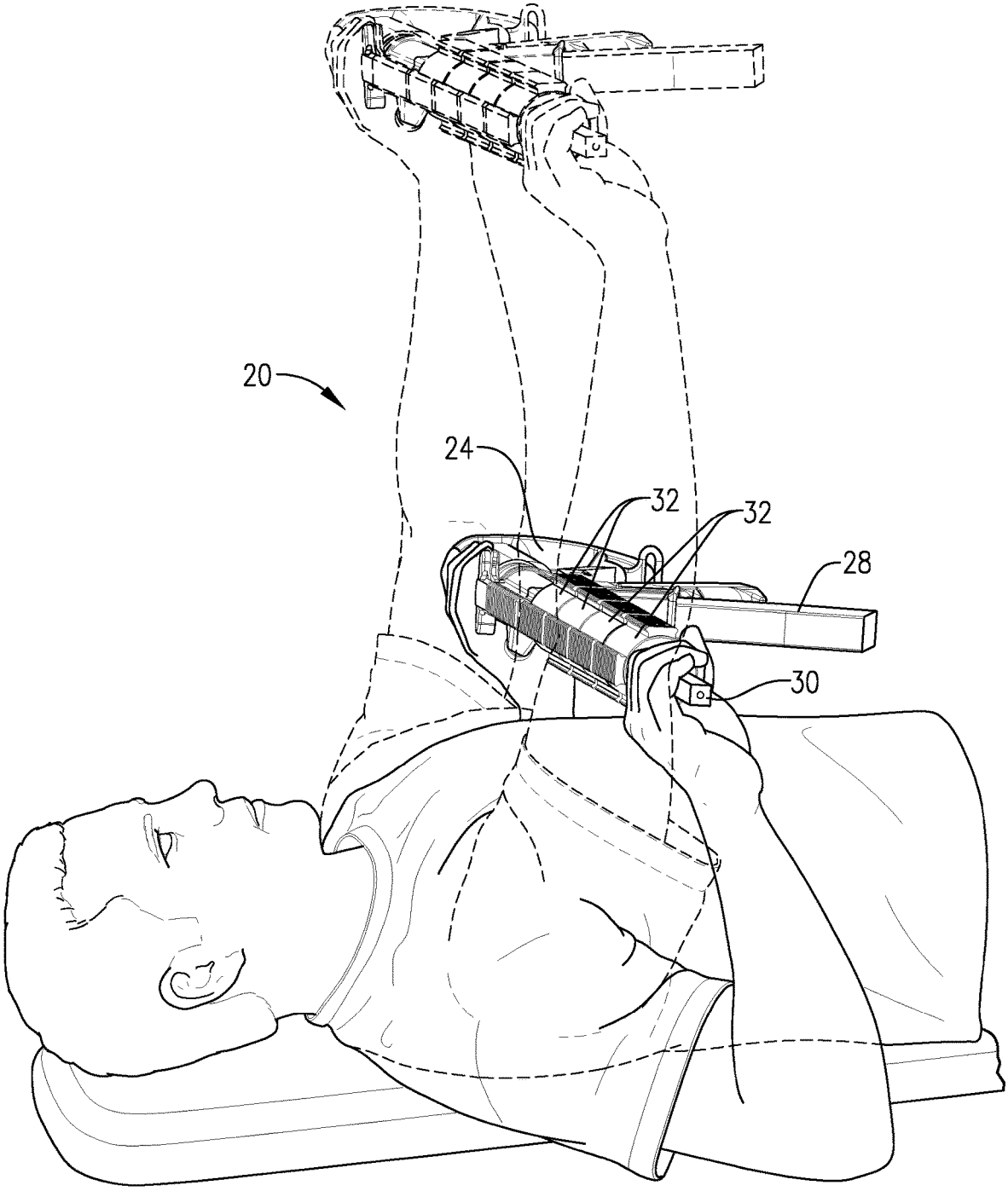
FIG. 3 is a perspective of the weighted replica firearm shown in FIGS. 1 and 2, showing the user holding the firearm while performing a bench press exercise.

Yet further, the receiver 22 preferably presents a mounting bracket 50 associated with an upper margin 52 of the receiver 22 (see FIGS. 1 and 4). The bracket 50 is preferably integrally formed with the rest of the receiver 22. In the depicted embodiment, the bracket 50 preferably comprises a mounting rail with a series of transverse slots 54 (see FIG. 4). Most preferably, the depicted bracket 50 comprises a so-called "Picatinny" rail, although the bracket 50 could take other forms without departing from the scope of the present invention. While the bracket 50 is integrally formed as part of the receiver 22, it will be appreciated that the bracket could be removably mounted to another part of the receiver (e.g., with threaded fasteners).

The bracket 50 is configured to permit removable attachment of one or more types of items to the upper margin 52 of the receiver 22. For instance, as depicted in subsequent embodiments, a firearm scope (i.e., an optical telescopic sight) can be configured for attachment to the bracket 50 of the firearm 20. It will be appreciated that any scope structure, or any other weighted structure, attached to the bracket 50 could include a replica scope or a working scope.

In preferred embodiments, a scope or other weighted structure attached to the bracket 50 is preferably configured to simulate the look and feel of a working firearm. Any such weighted structure is configured to add weight to the firearm 20 while preferably providing a balanced distribution of weight, particularly along the length of the firearm 20.

The depicted receiver 22 includes a replica frame or housing structure that is intended to mimic a working receiver. The illustrated receiver 22 also includes features that generally mimic other firearm elements associated with a working firearm (such as the bolt, trigger, hammer, safety, and other movable firing components) and operably mounted within, on, or adjacent to a working receiver.

However, the receiver 22 could be alternatively configured to include at least part of a working firearm receiver frame or an unfinished firearm receiver frame. Yet further, the receiver 22 could include other unfinished or working components that are formed separately from a receiver frame (whether the frame is a replica, unfinished, or working frame). For instance, the receiver 22 could include a bolt, trigger, hammer, safety, and/or other movable firing components that are separately formed and provided in replica form, unfinished form, or working form.

The receiver 22 is configured to be grasped by the user and preferably defines a distal simulated firing direction F. In the depicted embodiment, the arrangement of the grip 48 and trigger (among other features presented by the receiver 22) cooperatively define the firing direction F.

The stock 24 comprises a structure that can be grasped by a user and can be abutted against the user when using the firearm 20. The stock 24 can include at least part of a working stock, an unfinished stock, or a replica stock.

The stock 24 preferably includes a body 56, a removable butt plate 58, and removable weighted inserts 60*a,b* (see FIGS. 1 and 4). The body 56 is unitary and includes a distal threaded connection end 62 (see FIG. 4). The connection end 62 is operable to be threadably attached to the proximal stock connector 34 of the receiver 22. The body 56 also presents a proximal butt end 64 to receive the butt plate 58. The stock 24 includes a strap connector 66 attached adjacent to the butt end 64.

The body 56 further presents chambers 68 that extend distally from the butt end 64 (see FIG. 1). The chambers 68 permit the inserts 60*a,b* to be slidably inserted into (and removed from) the body 56. The butt plate 58 is removably attached to the butt end 64 with fasteners to enclose the chambers 68 and restrict removal of the inserts 60*a,b*.

However, the stock 24 could have an alternative adjustable weight arrangement without departing from the spirit of the present invention. For instance, the stock 24 could include one or more chambers configured to removably receive a ballast material, such as a granular material (e.g., sand or metal granules) or a liquid.

As with the receiver 22, the addition of weights or other weighted structure to the stock 24 is preferably configured to simulate the look and feel of a working firearm. Any such weighted structure is also configured to add weight to the firearm 20 while preferably providing a balanced distribution of weight, particularly along the length of the firearm 20.

The illustrated strap 26 mimics the size and shape of a conventional rifle strap. The strap 26 includes an elastic band 70, a fabric sleeve 72 slidably received on the band 70, and connector rings 74 (see FIGS. 1 and 2).

The elastic band 70 is unitary and includes an elastomeric material. The band 70 presents opposite ends that are fixed to corresponding rings 74. A distal one of the rings 74 is removably attached to one of the weights 32 with a threaded fastener 76 (see FIG. 1).

By having an elastic strap construction, the firearm 20 is configured to be used for certain stretching exercises and resistance training exercises. For instance, the user can perform seated rows with the firearm 20 by grasping the strap 26 and holding the rest of the firearm below the user's feet (see FIG. 2).

The barrel weight support 30 is provided to receive one or more barrel weights 32. The addition of one or more of the weights 32 (or other weighted structure) to the support 30 is preferably configured so that the support 30 and weights 32 cooperatively provide a replicated barrel 78 (see FIG. 1). That is, the support 30 and weights 32 cooperatively mimic the look and feel of a working firearm barrel. Furthermore, the weights 32 are preferably configured and received on the support 30 to provide a balanced distribution of weight along the length of the replicated barrel 78.

The depicted support 30 includes a unitary elongated beam 80 and a threaded proximal connector 82 that are integrally formed with one another (see FIG. 4). The support 30 also presents proximal and distal ends 84*a,b*.

The beam 80 has a generally square cross section that is substantially continuous along the length of the beam 80. The beam 80 also preferably presents a continuous outermost barrel surface 86 (see FIG. 4). The surface 86 provides a support connection interface that slidably receives one or more weights 32. The connector 82 preferably extends transversely beyond the surface 86 to provide a stop that is sized to restrict a weight 32 from sliding off of the proximal end 84*a*.

The support 30 further presents a series of threaded blind holes 88 spaced along the length of the beam 80. Each hole 88 is configured to threadably receive the threaded fastener 76 to secure one or more weights 32 on the support 30 (see FIG. 5). The threaded fastener 76 preferably comprises a cap screw with a head that presents a slotted opening 90 (see FIG. 5) to receive one of the rings 74.

The beam 80 preferably presents a support length dimension D1 (see FIG. 4) that is sized to receive weights 32 so that the support 30 and weights 32 cooperatively mimic a working barrel. It will be appreciated that an alternative support could present a length shorter than the depicted embodiment or longer than the depicted embodiment (as suggested by the dashed lines in FIG. 4, which depict an extension of the support at the distal end thereof). The support length dimension D1 preferably ranges from about six inches (6") to about forty-eight inches (48").

Figure 5:
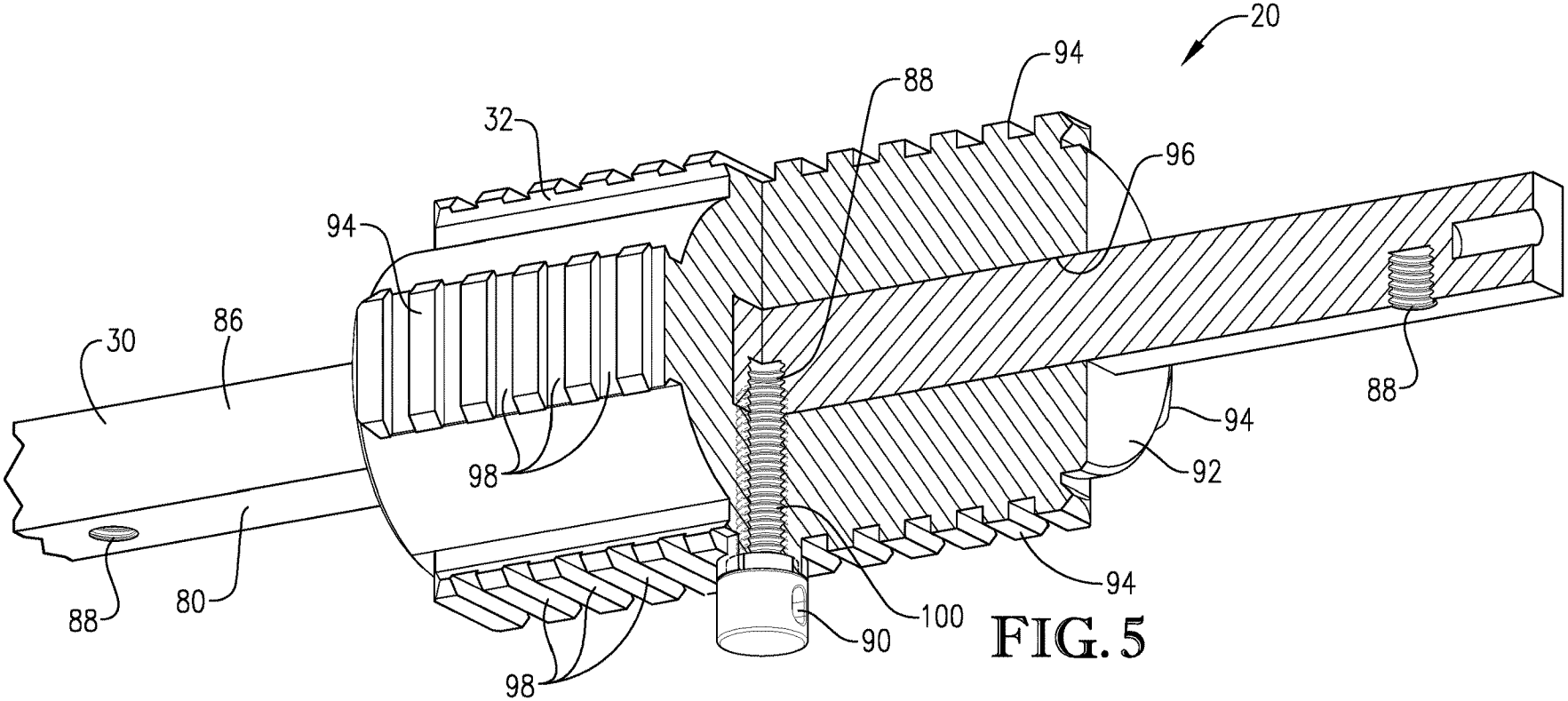
FIG. 5 is an enlarged fragmentary perspective view of the weighted replica firearm shown in FIGS. 1-4, which is partially sectioned to depict the preferred manner for attaching each of the barrel weights to the barrel weight support with a threaded fastener.

Turning to FIGS. 1, 4, and 5, one or more of the barrel weights 32 can be selectively mounted on the support 30 for various training routines. As will be described, the weights 32 can be mounted on the support 30 in various combinations and are preferably interchangeable with one another. As will also be described, the support 30 and weights 32 are used in combination to provide the replicated barrel 78, while preferably providing a balanced distribution of weight along the length of the replicated barrel 78.

The depicted weights 32 each preferably include a unitary tubular body 92 and a plurality of mounting brackets 94. The illustrated body 92 presents a longitudinal bore 96 with a square cross-sectional shape. The bore 96 is sized to slidably receive the beam 80 and defines a weight connection interface. Thus, the weight connection interface of each barrel weight 32 is removably interconnected with the support connection interface of the barrel weight support 30 when the barrel weight is mounted to the support 30.

The brackets 94 are preferably integrally formed with the body 92. Each bracket 94 preferably comprises a mounting rail with a series of transverse slots 98 (see FIG. 5). Most preferably, each of the depicted brackets 94 comprises a so-called "Picatinny" rail, although the bracket 94 could take other forms without departing from the scope of the present invention. In the usual manner, each bracket 94 provides a standardized mounting structure that is configured to removably attach a wide range of devices (e.g., a telescope sight, an iron sight, a strap connector, etc.) to the firearm 20.

The illustrated weight 32 preferably includes four (4) brackets 94 spaced circumferentially about the body 92, although an alternative number of brackets 94 could be used. While the body 92 and brackets 94 are integrally formed, it will be appreciated that the brackets 94 could be removably mounted to the body 92 (e.g., with threaded fasteners).

The weight 32 further presents a transverse threaded hole 100 that extends through one of the brackets 94 and the body 92 to intersect the longitudinal bore 96 (see FIG. 5). The hole 100 is configured to receive the threaded fastener 76 (see FIG. 5).

The weights 32 are preferably substantially identically sized and shaped. Furthermore, the weights 32 include substantially the same material so that the weights 32 have substantially the same weight value. The weights 32 shown in the depicted embodiment include a metallic material, such as alloy carbon steel or stainless steel. However, it is within the ambit of the present invention where each weight additionally or alternatively incorporates one or more other materials, such as a synthetic resin.

Again, the depicted weights 32 are preferably substantially identically sized and shaped and have substantially the same weight value. However, the principles of the present invention are applicable where the barrel weights are alternatively shaped. For instance, as will be shown in subsequent embodiments, the barrel weights could be alternatively shaped to have varying weight amounts. In one such alternative embodiment, multiple barrel weights could have the same cross-sectional shape while presenting various lengths that correspond to different weight values. In any event, such alternative barrel weights preferably have bore cross-sectional shapes that are substantially the same so that each barrel weight can be slidably mounted on the support.

As discussed above, the weights 32 are preferably mounted on the support 30 to provide the replicated barrel 78. In preferred embodiments, the weights 32 are mounted to provide a balanced distribution of weight along the length of the replicated barrel 78.

The illustrated weights 32 are each configured to be slidably mounted on the support 30 by inserting the beam 80 through the corresponding bore 96. In the depicted embodiment, four (4) weights 32 are mounted in series along the support 30 and are positioned in end-to-end abutting contact with one another (although at least some space could be presented between adjacent weights 32). The weights 32 are preferably secured on the support 30 by inserting the fastener 76 through the hole 100 of the distalmost weight 32 and threading the fastener 76 into engagement with the respective hole 88.

Each of the depicted weights 32 preferably has a weight value that preferably ranges from about two tenths of a pound (0.2 lbs) to about ten pounds (10 lbs) and, more preferably, from about one half pound (0.5 lbs) to about five pounds (5 lbs).

In the illustrated embodiment, the weights 32 cooperatively provide substantially all of the weight of the replicated barrel 78. That is, the support 30 has a weight amount that is negligible compared to the weight amount cooperatively provided by the weights 32. In various preferred embodiments, the weight amount cooperatively provided by the weights 32 ranges from about eighty percent (80%) to about ninety-five percent (95%) of the weight of the entire replicated barrel 78. As disclosed with subsequent embodiments, alternative weight configurations encompass the possibility of one or more weights providing one hundred percent (100%) of the weight of the replicated barrel.

The illustrated barrel weights 32 are preferably distributed substantially equally along the support length dimension D1 of the support 30. As a result, the replicated barrel 78 preferably presents a weight value that is substantially constant along the barrel length. In other words, the disclosed arrangement of barrel weights 32 on the support 30 preferably provides a uniform distribution of weight along at least substantially the entire length of the replicated barrel 78. Preferably, the weights 32 cooperatively define a weight length D2 that ranges from about eighty percent (80%) to about one hundred percent (100%) of the support length dimension D1. In some alternative embodiments, the weight length dimension D2 could also be greater than the support length dimension D1.

The barrel weights 32 are preferably configured to be used in combination with the weighted inserts 60 of the stock 24 and the magazine 28 to selectively control the distribution of weight along the entire firearm 20. It will be appreciated that the firearm 20 presents a center of gravity CG (see FIG. 1) that can be moved along the length of the firearm 20 by changing the configuration of the barrel weights 32, inserts 60, and/or the magazine 28.

Again, the illustrated grip 48 is preferably located between the stock 24 and barrel weights 32 so that the gravitational forces of the stock 24 (including weighted inserts associated with the stock 24) at least partly counterbalance the gravitational forces of the barrel weights 32 and the magazine 28. The configuration of the barrel weights 32, inserts 60, and/or the magazine 28 is operable to be changed to adjust the degree to which the various weights counterbalance one another.

The distalmost weight 32 and proximal connector 82 cooperatively retain the other weights 32 on the beam 80. As a result, the weights 32 other than the distalmost weight 32 are not required to be secured to the support 30 with fasteners. However, it will be appreciated that more than one of the weights 32 could also be attached to the support 30 by respective fasteners. For instance, each of the four (4) depicted weights 32 could be secured with a corresponding fastener.

When fewer than four (4) weights 32 are mounted on the support 30, the distalmost weight 30 is preferably attached with the fastener 76. For instance, if three (3) weights 32 are mounted on the support 30, the distalmost weight 32 is attached with a fastener 76 while the other two weights 32 are mounted on the beam 80 without fasteners. In such a configuration, the three (3) weights 32 are generally positioned in end-to-end abutting contact with one another (although at least some space could be presented between adjacent weights 32).

The distalmost weight 32 is preferably attached with the fastener 76 by threading the fastener 76 through the hole 100 and into the corresponding hole 88. However, because the hole 100 is threaded, the fastener 76 can also be threaded into frictional engagement with the surface 86 of the beam 80 to frictionally attach the weight 32 to the beam 80.

In the illustrated embodiment, the weights 32 are preferably interchangeably attachable to the support 30. That is, each weight 32 can be attached to the support 30 in place of any other weight 32. As will be shown in subsequent embodiments, such interchangeability can also be provided where the weights 32 are differently sized and shaped.

The illustrated weights 32 are preferably axially slidable into and out of engagement with the support 30 and are axially slidable along the support 30. However, it is also within the ambit of the present invention where the weights 32 are alternatively shiftably engaged with the support 30. For instance, each barrel weight could present an axial slot that permits the barrel weight to shift into and out of engagement with the support along a direction transverse to the axial direction.

Again, the weights 32 are preferably mounted in series axially along the support 30 and are positioned in end-to-end abutting contact with one another. This combination enables the support 30 and weights 32 to cooperatively mimic the look and feel of a working firearm barrel.

However, two or more of the weights 32 could be mounted axially in series but secured in locations spaced apart from one another so that no end-to-end contact occurs between each adjacent pair of weights 32. In one such alternative embodiment, each of the weights 32 is preferably secured with a corresponding fastener.

The weights 32 are preferably axially arranged in series along the length of the support 30 to mimic the look and feel of a working firearm barrel. However, in accordance with certain aspects of the present invention, multiple weights 32 could be arranged in a direction transverse to the barrel length. For instance, a series of barrel weights could be attached circumferentially about the barrel support. Similarly, one or more aspects of the present invention encompass the possibility of arranging a series of barrel weights in a lateral direction relative to the barrel length.

In various alternative weight arrangements, it will be appreciated that one or more of the barrel weights could be attached to structure other than the support. In some alternative embodiments, one or more weights could be removably attached to other weights. For some aspects of the present invention, adjacent pairs of the depicted weights could be removably attached to one another without being directly received on the support (e.g., where multiple weights are secured in series beyond the distal end of the support).

As described above, the weights 32 are secured on the support 30 by threading the fastener 76 through the weight 32 and into engagement with the support 30. However, the firearm 20 could include one or more alternative fasteners to attach the barrel weight to the support. For instance, the firearm could include various types of connection elements, such as pins, lugs, pawls, detents, collars, snap rings, threaded elements, etc., that removably interconnect the barrel weight and the support.

It is also within the ambit of the present invention where an alternative fastener is attached to the support to hold one or more barrel weights on the support without being attached to any of the barrel weights. For instance, the firearm could have a fastener positioned distally of the barrel weight and attached directly to the support. In one such alternative, the firearm could include a locking collar (e.g., with a set screw that engages one of the holes) secured to the support to lock the barrel weights in place. In alternative embodiments, the firearm could include various types of fastener elements, such as pins, lugs, pawls, detents, collars, snap rings, threaded elements, etc., that are directly attached to the support and without being attached to the barrel weights to hold one or more barrel weights on the support.

In use, the firearm 20 has various removable weight structures that are configured to control the distribution of weight along the firearm 20. The user can selectively attach and remove each of the barrel weights 32, weighted inserts 60, and magazine 28 to selectively adjust the distribution of weight. That is, the barrel weights 32, inserts 60, and/or the magazine 28 are operable to be adjusted to change how the weights counterbalance one another. For instance, these weight structures can be selectively attached or removed to counteract any perceived imbalance in the firearm 20 when the user holds the firearm 20 by the grip 48.

ALTERNATIVE EMBODIMENTS

Turning to FIGS. 6-16*b*, alternative preferred embodiments of the present invention are depicted.

With initial attention to FIG. 6-8*d*, an alternative weighted replica firearm 200 is constructed in accordance with a second preferred embodiment of the present invention. The description of this alternative firearm 200 will focus primarily on the differences of this embodiment from the first preferred embodiment described above.

The replica firearm 200 comprises a replica rifle and preferably includes a receiver 202, interchangeable stocks 204*a,b*, interchangeable scopes 206,208, barrel weight support 210, and interchangeable barrel weights 212*a,b,c*.

In the illustrated embodiment, the receiver 202 includes a replica firearm frame operable to support other components of the firearm 200. The depicted receiver 202 also preferably includes a proximal stock connector 214 with a female connection interface 216 (see FIG. 7). The receiver 202 further includes a firearm grip 218 located adjacent the stock 204 and operable to be grasped by a user.

Also in the depicted embodiment, the receiver 202 preferably presents a mounting bracket 220 associated with an upper margin 222 of the receiver 202. The bracket 220 is preferably integrally formed with the rest of the receiver 202. The bracket 220 is configured to permit removable attachment of one of the firearm scopes 206,208. The scopes 206,208 have corresponding weight values that are different from each other and are interchangeably attached to the bracket 220.

Each stock 204 comprises a removable structure that can be grasped by a user and can be abutted against the user when using the firearm 200. The stocks 204 can each include at least part of a working stock, an unfinished stock, or a replica stock.

The stocks 204 each preferably include a unitary body with a distal connection end 224 (see FIGS. 7 and 8*a*). The connection end 224 comprises a fractional-turn connector that is complementally shaped relative to the proximal stock connector 214 and is operable to be removably attached to the proximal stock connector 214. The stocks 204 are differently shaped and have corresponding weight values that are different from each other to adjust the distribution of weight adjacent the distal end of the firearm 200.

The barrel weight support 210 is provided to receive one of the illustrated barrel weights 212*a,b,c*. The support 210 and weights 212 cooperatively provide a replicated barrel 226 (see FIG. 6).

The depicted support 210 is integrally formed as part of the receiver and presents a female threaded connector 227 in the form of a threaded socket (see FIG. 7). The connector 227 preferably provides a female support connection interface configured to threadably receive and to be removably engaged with the male threaded connector of one of the barrel weights 212.

Although the female connector 227 preferably comprises a threaded connector, the connector 227 could include various alternative female connectors without departing from the scope of the present invention. In one such alternative embodiment, the female connector could include a fractional-turn connector. It will be appreciated that alternative female connectors will similarly comprise a socket to receive a complemental male connector of the barrel weight.

As will be shown in subsequent embodiments, the barrel weight support could alternatively comprise a male threaded connector threadably engaged with a female connector of a barrel weight. Yet further, the barrel weight support could include an intermediate coupler located between the rest of the support and the barrel weight to interconnect the support and barrel weight to one another. In such an alternative embodiment, the intermediate coupler could a combination of male and/or female connectors.

The barrel weights 212 are preferably interchangeable with one another so that the barrel weights 212 can be alternatively removably attached to the support 210. The depicted weights 212 each preferably include a unitary body that includes a proximal connector 228. The proximal connector 228 preferably comprises a threaded stub shaft and provides a weight connection interface configured to be threadably engaged with the female threaded connector 227. The barrel weights 212 each have a different shape and have corresponding weight values that are different from one another.

Although the proximal connector 228 preferably comprises a threaded connector, the connector 228 could include various alternative male connectors without departing from the scope of the present invention. In one such alternative embodiment, the male connector could include a fractional-turn connector. It will be appreciated that alternative male connectors will similarly comprise a stub shaft configured to be inserted into the socket of a complemental female connector of the barrel weight support.

As will be shown in subsequent embodiments, each barrel weight could alternatively comprise a female threaded connector threadably engaged with a male connector of a barrel weight. Also, each barrel weight could include an intermediate coupler located between the support and the rest of the barrel weight to interconnect the support and barrel weight to one another. In such an alternative embodiment, the intermediate coupler could have a combination of male and/or female connectors.

Turning to FIGS. 9-11*b*, an alternative weighted replica firearm 300 is constructed in accordance with a third preferred embodiment of the present invention. The description of this alternative firearm 300 will focus primarily on the differences of this embodiment from the first preferred embodiment described above.

The replica firearm 300 comprises a replica shotgun and preferably includes a receiver 302, interchangeable stocks 304,306, a barrel weight support 310, and removable barrel weights 312.

In the illustrated embodiment, the receiver 302 includes a replica firearm frame operable to support other components of the firearm 300. The depicted receiver 302 also preferably includes a proximal stock connector 314 and a distal barrel connector 316. The proximal stock connector 314 includes a female connection interface 318 (see FIG. 10). The receiver 302 further includes a firearm grip 320 located adjacent the stock 304 and operable to be grasped by a user.

The distal barrel connector 316 provides a threaded female connection interface 322 (see FIG. 10). The threaded connection interface 322 of the distal barrel connector 316 is configured to be removably attached to a threaded connection end of the barrel weight support 310.

Each stock 304,306 comprises a removable structure that can be grasped by a user and can be abutted against the user when using the firearm 300. The stocks 304,306 each preferably include a unitary body with a distal connection end 324 (see FIGS. 10 and 11*a*). The connection end 324 comprises a fractional-turn connector that is complementally shaped relative to the proximal stock connector 314 and is operable to be removably attached to the proximal stock connector 314. The stocks 304 are differently shaped and have corresponding weight values that are different from each other to adjust the distribution of weight adjacent the distal end of the firearm 300.

The barrel weight support 310 is configured to receive one or more of the barrel weights 312. The support 310 and weights 312 cooperatively provide a replicated barrel 326 (see FIGS. 9 and 10).

The depicted support 310 includes a unitary elongated tube 328 and a threaded proximal connector 330 that are integrally formed with one another. The support 310 also presents proximal and distal ends 332*a*,*b*, with the proximal end 332*a* being enclosed and the distal end 332*b* being open.

The tube 328 preferably presents a continuous interior barrel surface 334 that forms a bore 336 (see FIG. 11*b*). The surface 334 provides a support connection interface that slidably receives one or more weights 312.

The barrel weights 312 are preferably interchangeable with one another so that the barrel weights 312 can be alternatively removably attached to the support 310. The depicted weights 212 each preferably include a unitary cylindrical body that presents a continuous exterior weight surface 338.

The barrel weights 312 are preferably substantially identically sized and shaped. Furthermore, the weights 312 include substantially the same material so that the weights 312 have substantially the same weight value. However, the principles of the present invention are applicable where the barrel weights are alternatively shaped and have varying weight amounts. In one such alternative embodiment, multiple barrel weights could have the same cross-sectional shape while presenting various lengths that correspond to different weight values.

Again, the weights 312 are preferably mounted within the support 310 to provide the replicated barrel 326. In preferred embodiments, the weights 312 are mounted to provide a balanced distribution of weight along the length of the replicated barrel 326.

The illustrated barrel weights 312 are each configured to be slidably mounted on the support 310 by inserting the weight 312 through the open end 332*b* and into the bore 336. In the depicted embodiment, two (2) weights 312 are mounted in series along the support 310 and are positioned in end-to-end abutting contact with one another. The weights 312 are preferably secured within the support 310 by engaging a fastener (not shown) with the distalmost weight 312.

The illustrated barrel weights 312 are preferably distributed substantially equally along the length of the support 310. As a result, the replicated barrel 326 preferably presents a weight value that is substantially constant along the barrel length.

Turning to FIGS. 12-14*b*, an alternative weighted replica firearm 400 is constructed in accordance with a fourth preferred embodiment of the present invention. The description of this alternative firearm 400 will focus primarily on the differences of this embodiment from the first preferred embodiment described above.

The replica firearm 400 comprises a semi-automatic pistol and preferably includes a receiver 402, interchangeable magazines 404,406,408, a barrel weight support 410, and interchangeable barrel weights 412*a,b*.

In the illustrated embodiment, the receiver 402 includes a replica firearm frame operable to support other components of the firearm 400. The depicted receiver 402 also preferably includes a firearm grip 414 operable to be grasped by a user.

The depicted receiver 402 further includes a magazine connector 416 integrally formed as part of the grip 414. The magazine connector 416 preferably comprises a magazine slot 418 that slidably and alternatively receives the magazines 404,406,408 (see FIG. 12).

Each magazine 404,406,408 can preferably be grasped by a user and removably attached to the receiver 402. Each magazine 404,406,408 preferably comprises a unitary body and includes a connection end 420 that is removably attachable to the magazine connector 416.

The connection end 420 of the magazine 404,406,408 is configured to be removably inserted within the magazine slot 418 and attached to the magazine connector 416 via a detachable connection mechanism (not shown). For instance, the magazine connector 416 and magazine 404, 406,408 can include complemental detent elements that cooperatively provide the connection mechanism.

The illustrated magazines 404,406,408 have different shapes and present weight values that are different from one another. Therefore, the magazines 404,406,408 are configured to selectively add variable weight to the firearm 400. If desired, the magazine connected to the receiver 402 may be selected with the appropriate barrel weight 412 to provide a balanced distribution of weight, particularly along the length of the firearm 400.

The barrel weight support 410 is provided to alternatively receive each of the illustrated barrel weights 412*a,b*. The support 410 and weights 412 cooperatively provide a replicated barrel 422.

The depicted support 410 is integrally formed as part of the receiver and presents a male threaded connector 424 with a threaded male stub shaft (see FIG. 12). The connector 424 preferably provides a male support connection interface configured to threadably receive and to be removably engaged with the female threaded connector of one of the barrel weights 412.

Although the male connector 424 preferably comprises a threaded connector, the connector 424 could include various alternative male connectors without departing from the scope of the present invention. In one such alternative embodiment, the male connector could include a fractional-turn connector. In at least some embodiments, it will be appreciated that alternative male connectors may comprise a stub shaft to be inserted in a complemental female connector of the barrel weight.

The barrel weights 412*a,b* are preferably interchangeable with one another so that the barrel weights 412 can be alternatively removably attached to the support 410. The depicted weights 412 each preferably include a unitary body that includes a proximal connector 426. The proximal connector 426 preferably comprises a threaded female connector and provides a female weight connection interface configured to be threadably engaged with the male threaded connector 424. The barrel weights 412 each have a different shape and have corresponding weight values that are different from each other.

Although the proximal connector 426 preferably comprises a threaded connector, the connector 426 could include various alternative female connectors without departing from the scope of the present invention. In one such alternative embodiment, the female connector could include a fractional-turn connector. It will be appreciated that alternative female connectors will also preferably comprise a socket configured to receive a complemental male shaft of the barrel weight support.

Turning to FIGS. 15-16*b*, an alternative weighted replica firearm 500 is constructed in accordance with a fifth preferred embodiment of the present invention. The description of this alternative firearm 500 will focus primarily on the differences of this embodiment from the first preferred embodiment described above.

The replica firearm 500 comprises a revolver and preferably includes a receiver 502, a barrel weight support 504, and interchangeable barrel weights 506*a,b,c*.

In the illustrated embodiment, the receiver 502 includes a replica firearm frame operable to support other components of the firearm 500. The depicted receiver 502 also preferably includes a firearm grip 508 operable to be grasped by a user.

The barrel weight support 504 is provided to alternatively receive each of the illustrated barrel weights 506*a,b,c*. The support 504 and weights 506 cooperatively provide a replicated barrel 510.

The depicted support 504 is integrally formed as part of the receiver and presents a male threaded connector 512 with a threaded male stub shaft (see FIG. 15). The connector 512 preferably provides a male support connection interface configured to threadably receive and to be removably engaged with the female threaded connector of each of the barrel weights 506.

Although the male connector 512 preferably comprises a threaded connector, the connector 512 could include various alternative male connectors without departing from the scope of the present invention. In at least some embodiments, it will be appreciated that alternative male connectors may comprise a stub shaft to be inserted in a complemental female connector of the barrel weight.

The barrel weights 506*a,b,c* are preferably interchangeable with one another so that the barrel weights 506 can be alternatively removably attached to the support 504. The depicted weights 506 each preferably include a unitary body that includes a proximal connector 514. The proximal connector 514 preferably comprises a threaded female connector and provides a female weight connection interface configured to be threadably engaged with the male threaded connector 512. The barrel weights 506 each have a different shape and have corresponding weight values that are different from one another.

Although the proximal connector 514 preferably comprises a threaded connector, the connector 514 could include various alternative female connectors without departing from the scope of the present invention. It will be appreciated that alternative female connectors will also preferably comprise a socket configured to receive a complemental male shaft of the barrel weight support.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A weighted replica firearm operable to be handled by a user for simulated firearm training, said weighted replica firearm comprising:

a firearm receiver configured to be grasped by the user;

a barrel weight support associated with the firearm receiver, said barrel weight support including a support connection interface; and a plurality of removable barrel weights selectively mounted to the barrel weight support, each of said barrel weights including a corresponding weight connection interface removably interconnecting with the support connection interface when the barrel weight is mounted to the barrel weight support, said barrel weights being alternatively mounted to the barrel weight support, with at least some of the barrel weights having varying weight amounts, one of said support connection interface or each of said weight connection interfaces presenting a socket, and the other of said support connection interface or each of said weight connection interfaces presenting a stub shaft, said stub shaft being inserted into the socket when each barrel weight is mounted to the barrel weight support.

2. The weighted replica firearm as claimed in claim 1, said barrel weight support extending from the firearm receiver in a distal simulated firing direction.

3. The weighted replica firearm as claimed in claim 1, said barrel weight support being configured to support only one of the barrel weights at a time.

4. The weighted replica firearm as claimed in claim 1, said stub shaft and said socket being threadably interconnected when each barrel weight is mounted to the barrel weight support.

5. The weighted replica firearm as claimed in claim 1, said socket being defined in the firearm receiver, such that the barrel weight support is integrated with the firearm receiver, each of said barrel weights including the stub shaft.

6. The weighted replica firearm as claimed in claim 1, said barrel weight support comprising the stub shaft, said stub shaft fixedly extending from the firearm receiver in a distal simulated firing direction, each of said barrel weights including the socket.

7. The weighted replica firearm as claimed in claim 1, said receiver and said barrel weight support being removably attached to one another.

8. The weighted replica firearm as claimed in claim 1, said barrel weight support and one or more of said barrel weights cooperatively defining a replicated barrel of the firearm, said replicated barrel extending from the receiver in a distal simulated firing direction; and a proximal weight removably attached relative to the firearm receiver at an attachment location spaced proximally of the replicated barrel.

9. The weighted replica firearm as claimed in claim 8, said firearm receiver presenting opposite proximal and distal receiver ends, said replicated barrel projecting from the distal receiver end, said attachment location being adjacent the proximal receiver end.

10. The weighted replica firearm as claimed in claim 9, said firearm receiver including a grip located between the proximal and distal receiver ends, such that the gravitational forces of the proximal weight and the one or more barrel weights at least partly counterbalance one another.

11. The weighted replica firearm as claimed in claim 9, said proximal weight comprising a plurality of stock weights alternately attachable relative to the firearm receiver adjacent the proximal receiver end, with at least some of the stock weights having varying stock weight amounts.

12. The weighted replica firearm as claimed in claim 9, said firearm receiver including a grip, said proximal weight comprising a plurality of magazine weights alternately attachable relative to the firearm receiver in closer proximity to the grip than the replicated barrel, with at least some of the magazine weights having varying magazine weight amounts.

13. The weighted replica firearm as claimed in claim 12, said grip including a magazine slot, each of said magazine weights configured to be at least party received in the magazine slot.

14. The weighted replica firearm as claimed in claim 1, said barrel weight support and one or more of said barrel weights cooperatively defining a replicated barrel of the firearm, said replicated barrel extending from the receiver in a distal simulated firing direction, said replicated barrel presenting a barrel length defined along the firing direction, said replicated barrel presenting a weight value that is substantially constant along the barrel length.

* * * * *